US005910223A

United States Patent [19]

Tipton et al.

[11] Patent Number: 5,910,223

[45] Date of Patent: Jun. 8, 1999

[54] STEEL ARTICLE HAVING HIGH HARDNESS AND IMPROVED TOUGHNESS AND PROCESS FOR FORMING THE ARTICLE

[75] Inventors: Sheryl A. Tipton, East Peoria; Gary D. Keil, Elmwood, both of Ill.

[73] Assignee: Caterpillar Inc., Peoria, Ill.

[21] Appl. No.: 08/978,326

[22] Filed: Nov. 25, 1997

[51] Int. Cl.[6] ..... C22C 38/02; C23C 8/22

[52] U.S. Cl. ..... 148/210; 148/233; 148/319

[58] Field of Search ..... 148/210, 233, 148/319

[56] References Cited

U.S. PATENT DOCUMENTS

| | | | |
|---|---|---|---|
| 4,921,025 | 5/1990 | Tipton et al. | 148/16.5 |
| 5,536,335 | 7/1996 | Burris | 148/233 |

FOREIGN PATENT DOCUMENTS

| | | | |
|---|---|---|---|
| 53-146233 | 12/1978 | Japan | 148/233 |
| 61-250109 | 11/1986 | Japan | 148/233 |

*Primary Examiner*—Deborah Yee
*Attorney, Agent, or Firm*—Calvin E. Glastetter

[57] ABSTRACT

A steel article is formed of a steel material containing from about 0.08 to about 0.35 carbon and is characterized by having a plurality of carbides dispersed on at least one pre-selected surface area of the article, with the surface carbides being dispersed within a predominantly lower bainitic matrix. A method for forming the steel article having high hardness and higher toughness includes carburizing the article at a temperature and for a period of time, in an atmosphere having a carbon potential, sufficient to form carbides and austenite on at least one preselected surface of the article, and then quenching the carburized article to a temperature below the $Ar_1$ temperature and above the $M_s$ temperature of the steel material for a time sufficient to transform a major portion of the austenite in the preselected surface area microstructure to lower bainite. The steel article has an equivalent Knoop 500 gram maximum particle hardness of at least 900 and a Charpy unnotched, room temperature toughness of at least 50 Joules, thereby providing an article having both high hardness and improved toughness properties.

7 Claims, 1 Drawing Sheet

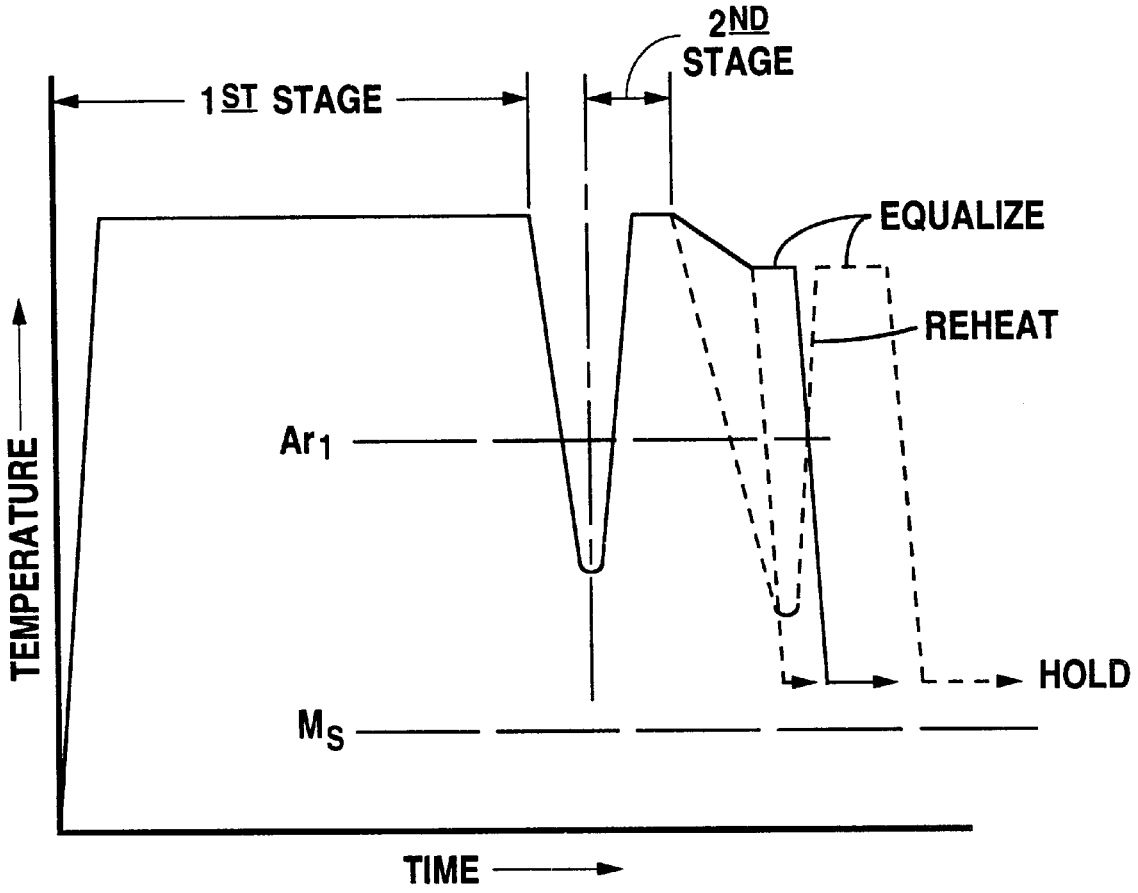
2ND
STAGE
1ST STAGE
EQUALIZE
REHEAT
Ar1
HOLD
Ms
TEMPERATURE
TIME

STEEL ARTICLE HAVING HIGH HARDNESS AND IMPROVED TOUGHNESS AND PROCESS FOR FORMING THE ARTICLE

TECHNICAL FIELD

This invention relates generally to a steel article having both high particle hardness and improved toughness characteristics and to a method performing such an article, and more particularly to a steel article and method by which a plurality of carbides are dispersed in a lower bainitic matrix on selected surfaces of the article.

BACKGROUND ART

Carburized components typically exhibit high hardness and low to moderate toughness. It is well known that one method of increasing the contact fatigue and scoring resistance of a conventionally carburized component is to utilize processes which form hard particles such as carbides in the surface microstructure, such as the process disclosed in U.S. Pat. No. 4,921,025 by Tipton et al. and assigned to the assignee of the present invention.

It is also well known that one method to increase toughness is to carburize and then austemper to produce a tougher case microstructure consisting primarily of lower bainite. This process of carburizing and austempering is commonly referred to as "Carbo-Austempering", and is known to increase the toughness of carburized components because at an equivalent hardness, a bainitic microstructure is tougher than a conventional martensitic microstructure. However, the accompanying hardness reduction results in undesirable lowering of wear, contact fatigue, and scoring resistance.

Carbo-Austempering of low and medium carbon steels is described in an article by W. R. Keough, titled *Carbo-Austempering,* published in 1995 (Carburizing and Nitriding with Atmospheres, Proceedings of the Second International Conference on Carburizing and Nitriding with Atmospheres, December, 1995, ASM International). However, it is commonly known by those skilled in the art that austempering of low and medium carbon steels, such as SAE8615, SAE4122, and SAE4150, effectively increases toughness, but result in lower surface hardness.

Steel articles produced by the process described in the above-referenced U.S. Pat. No. 4,921,025 have a plurality of carbides formed on the surface which provide high surface hardness. However, the articles, even though formed of lower to medium carbon steel, have relatively low toughness properties because the carbides are distributed in primarily a martensitic case microstructure.

It is therefore desirable to have a steel article, and a method of forming the article, that has both high surface hardness and higher toughness, without having a high core carbon content or the addition of relatively expensive carbide forming elements.

SUMMARY OF THE INVENTION

In accordance with one aspect of the present invention, an article formed of a steel material containing, by weight percent from about 0.08 to about 0.35 carbon, has a microstructure characterized by the presence of a plurality of surface carbides on at least one pre-selected surface of the article, with the surface carbides being dispersed in a predominantly lower bainitic matrix.

Other features of the article embodying the present invention include surface carbides having an equivalent Knoop 500 gram maximum particle hardness of at least 900, and an unnotched Charpy sample of the article, prepared in accordance with ASTM Standard E23, has a toughness of least 50 joules as measured on the Charpy Impact tester at 25° C. Still other features of the article include the steel material in which the article is formed having less than about 0.11% silicon and less than about 1.1% chromium.

Additional features of the article embodying the present invention include carbides being present on at least about 20% of the pre-selected surface of the article. Additional features of the steel material, from which the article embodying the present invention is formed, include the material having a composition, by weight percent, from about 0.08 to about 0.35 carbon, from about 0.3 to about 1.7 manganese, less than about 0.2 to about 2.5 carbide forming elements including chromium, less than 6.0 additional hardenability agents, less than about 1.1 grain refining elements, and not more than about 0.15 copper, with the balance consisting of iron and trace impurities.

In another aspect of the present invention, a method of forming a steel article having higher toughness and containing higher hardness carbide particles, comprises selecting a steel material that is hardenable by carburizing and contains, by weight percent, from about 0.08 to about 0.35 carbon. The steel material is shaped to form an article and carburized at a temperature, and for a period of time, in an atmosphere having a carbon potential sufficient to form at least one selected surface area on the article which has carbides dispersed in austenite. The carburized article is quenched to a temperature below the $Ar_1$ temperature and above the $M_s$ temperature of the carburized case, for a time sufficient to transform at least about 70% of the austenite in the selected surface area microstructure to lower bainite.

BRIEF DESCRIPTION OF THE DRAWING

A more complete understanding of the article and method of the present invention may be had by reference to the following detailed description when taking in conjunction with the accompanying single drawing which is a graphical representation of the time and temperature relationship of the carburizing and hardening process embodying the present invention.

DETAILED DESCRIPTION OF A PRESENTLY PREFERRED EXEMPLARY EMBODIMENTS

The present invention is specifically directed to a method of forming steel articles containing higher hardness carbide particles and having higher toughness from low to medium carbon, i.e., from about 0.08% to about 0.35% carbon, steel. In the following described examples, test samples were formed of a modified version of SAE 4122 steel, a steel hardenable by carburizing, and having a composition as listed in Table 1.

TABLE I

| COMPOSITION BY WEIGHT PERCENT | |
|---|---|
| Element | SAE 4122 |
| Carbon | 0.21 |
| Manganese | 0.95 |
| Silicon | 0.02 |
| Phosphorus | 0.01 |
| Sulfur | 0.025 |
| Chromium | 0.97 |
| Nickel | 0.06 |
| Molybdenum | 0.42 |

TABLE I-continued

| COMPOSITION BY WEIGHT PERCENT | |
|---|---|
| Element | SAE 4122 |
| Aluminum | 0.28 |
| Copper | 0.06 |
| Titanium | 0.001 |

Four samples of a steel material having the above composition were prepared for testing. The first test sample was subjected to a conventional carburizing and hardening treatment. A second sample was conventionally carburized and then austempered. A third sample was treated, in accordance with the process described in the herein incorporated U.S. Pat. No. 4,921,025, to form a plurality of surface carbides on the exposed surfaces of the sample. The referenced process is specifically directed to forming a surface having a high density of carbides in a predominately martensitic matrix. The fourth sample, embodying the article and method of the present invention, was carburized in accordance with the process outlined in U.S. Pat. No. 4,921,025 to form a plurality of carbides on the exposed surfaces of the article, and then austempered.

The four test samples were prepared in accordance with ASTM Standard E 23 for impact testing. More specifically, each sample was about 55 millimeters long and had a 10 millimeter square cross section. In accordance with accepted procedure for impact testing of surface or case hardened materials, the samples were not notched. When tested on a Charpy Impact tester at room temperature (about 25° C.) the respective impact values were recorded and listed below in Table II. For sample Nos. 1 and 2, the maximum particle hardness was measured on a microhardness tester. For sample Nos. 3 and 4, the carbide hardness was measured directly using a nanoindentor. The measured hardness and toughness values for the respective test samples are listed in Table II:

TABLE II

| Sample No. (Composition Shown in Table I) | Toughness Charpy Unnotched @ 25° C.; Joules (ft-lbs) | Hardness Maximum Particle Hardness (Equiv. Knoop, 500 gram) | Comment |
|---|---|---|---|
| 1. Conventional carburizing and hardening | 28 (21) | 754 | Problem - low toughness and absence of hard particles results in lower impact strength and lower wear, contact fatigue and scoring resistance |
| 2. Carburizing and austempering | 100 (74) | 688 | Problem - improved toughness but low hardness results in higher impact strength but still have lower wear, contact fatigue and scoring resistance |
| 3. Carbide producing process per U.S. Pat. No. 4,921,025 issued May 1, 1990 | 20 (15) | 1400 | Problem - high particle hardness results in higher wear, contact fatigue and scoring resistance, but low toughness results in low impact strength |
| 4. Carbide producing process per U.S. Pat. No. 4,921,025 and austempering | 87 (64) | 1400 | Solution - high particle hardness and improved toughness results in higher wear, contact fatigue, scoring resistance and also higher impact strength |

As described above, the test samples were all formed of the above-identified modified SAE 4122 steel, representing a low to medium carbon steel. Samples 1 and 2 were subjected to a conventional carburizing treatment to form a high carbon case with no surface carbides. Sample 1 exhibited a low toughness of 28 Joules, typical of conventional carburizing and hardening. Test sample 2 was austempered to provide a lower bainitic matrix surface microstructure and exhibited the highest toughness of 100 Joules; however the corresponding reduction in hardness is undesirable for wear, contact fatigue, and scoring resistance.

Test Sample Nos. 3 and 4 were treated in accordance with the process described in the above-referenced, herein incorporated, U.S. Pat. No. 4,921,025. Test Sample Nos. 3 and 4 were carburized at a temperature, and for a period of time, in an atmosphere having a carbon potential sufficient to form carbides and austenite on the surface of the sample. More specifically, as described in greater detail in the aforementioned U.S. Pat. No. 4,921,025, the processing of SAE 4122 steel Samples 3 and 4 included a first stage carburizing cycle in which the test pieces were placed in the pre-heated furnace in which the carbon potential of the gas atmosphere in the furnace was maintained at a level about equal to the saturation limit of carbon in austenite at the furnace temperature. The test pieces were held in the furnace, under those conditions, for a period sufficient to form about 75% to about 95% of the final case depth. Test pieces 3 and 4 were gas quenched, after the first stage, at a rate sufficient to suppress carbide nucleation on the carburized surface. The gas quench was continued until the temperature of the test piece was reduced to a temperature below the $Ar_1$ temperature to assure the substantially complete transformation to bainite and/or pearlite. Each of the test Samples 3 and 4 were then further carburized in a second stage in which the test pieces were placed in a pre-heated furnace in which the carbon content was maintained at a level greater than the saturation limit of carbon in austenite at the furnace temperature. Test pieces 3 and 4 were held in the furnace during the second stage carburizing for a period of time sufficient to form a high density of surface carbides dispersed in austenite. Test Sample 3 was then quenched to transform the surface to a microstructure of martensite, retained austenite and carbides, as taught in U.S. Pat. No.

4,921,025. Test Sample 3 has high particle hardness resulting in higher wear, contact fatigue and scoring resistance, but the low toughness, as shown in Table II, results in lower impact strength.

As illustrated in the sole drawing FIGURE, Test Sample No. 4 was quenched to a temperature below the $Ar_1$ temperature and above the $M_s$ temperature (the temperature at which martensite begins to form) and held at that temperature for a time sufficient to form at least about 70% of the austenite in the surface microstructure to lower bainite. Desirably, the article is held at a temperature about 25° C. (45° F.) above the $M_s$ temperature of the material. In the herein described test, Test Sample No. 4 was held at about 260° C. (500° F.) for about two hours and then cooled to room temperature. The surface area of Test Sample No. 4 was examined and found to contain about 22% carbides, i.e., carbides comprised about 22% of the surface area of sample. Desirably, in an article formed in accordance with the present invention, a quantifiable preselected area of the article will contain at least about 20% carbides dispersed in a predominately lower bainitic matrix.

Importantly, as shown in Table II, Test Sample No. 4, having a plurality of surface carbides disbursed in a predominantly lower bainitic matrix exhibited both high hardness and surprising high toughness for a sample with a plurality of embrittling carbides.

Based on the above tests, it is now believed that low to medium carbon steels, containing from about 0.8% to about 0.35% carbon, and preferably having silicon content less than about 0.11% and a chromium content less than about 1.1% are suitable materials for use in the above-described process whereby a plurality carbides are dispersed within a predominantly lower bainitic matrix. In particular, the steel material specifically defined in the incorporated U.S. Pat. No. 4,921,025 in which the steel material comprises, by weight percent, of from about 0.08 to about 0.35 carbon, from about 0.3 to about 1.7 manganese, less than about 0.10 silicon, less than about 1.1 chromium, from about the 0.2 to about 2.5 carbide forming elements including chromium, less that than 6.0 additional hardenability agents, less than 1.0 grain refining elements, and not more than about 0.15 copper, with the balance being iron and trace impurities, is particularly suitable for forming steel articles having high toughness and high particle hardness in accordance with the method embodying the present invention.

Also, as is demonstrated herein, articles of a steel material represented by modified SAE 4122 steels having a composition, by weight percent, of from about 0.19 to about 0.23 carbon, from about 0.80 to about 1.10 manganese, no more than about 0.02 phosphorus, from about 0.015 to about 0.025 sulphur, no more than about 0.10 silicon, from about 0.45 to about 1.00 chromium, from about 0.18 to about 0.45 molybdenum, no more than about 0.10 nickel, no more than about 0.10 copper, no more than about 0.02 titanium, when carburized and austempered in accordance with the present invention to provide a plurality of surface carbides dispersed in a predominately lower bainitic matrix, exhibits unexpectedly higher toughness.

Although the present invention is described in terms of a preferred exemplary embodiment, with specific reference to SAE 4122 steel, those skilled in the art will recognize that other low to medium carbon steels which can be carburized to form a plurality of carbides on all or pre-selected surfaces of the article, may be made without departing from the spirit of the invention. Such changes are intended to fall within the scope of the following claims. Other aspects features and advantages of the present invention may be obtained from the study of this disclosure, along with the appended claims.

We claim:

1. An article formed of a steel material containing from about 0.08 percent to about 0.35 percent carbon and no more than 0.10 percent silicon and having a microstructure characterized by the presence of a plurality of surface carbides on at least one preselected surface of said article, said surface carbides being dispersed in a predominately lower bainitic matrix.

2. An article, as set forth in claim 1, wherein said at least one preselected surface of the articles defines a quantifiable area, and said carbides are present on at least about 20% of the quantifiable area of said preselected surface.

3. An article, as set forth in claim 1, wherein said steel material contains less than about 1.1 percent chromium.

4. An article, as set forth in claim 1, wherein said steel material comprises, by weight percent, from about 0.08% to about 0.35% carbon, from about 0.3% to about 1.7% manganese, less than about 0.10% silicon, less than about 1.1% chromium, from 0.2% to about 2.5% carbide forming elements including said chromium, less than 6% additional hardenability agents, less than about 1% grain refining elements, not more than about 0.15 copper, and the balance iron and trace impurities.

5. An article, as set forth in claim 1, wherein said surface carbides have an equivalent Knoop 500 gram maximum particle hardness of at least about 900, and an unnotched sample of said article prepared in accordance with ASTM Standard E23 has a toughness of at least 50 Joules as measured on a Charpy impact tester at 25° C.

6. A method of forming a steel article having high toughness and hardness, comprising:

selecting a steel material that is hardenable by carburizing and containing, by weight percent, from about 0.08 to about 0.35 carbon;

shaping said steel material to form an article;

carburizing said article at a temperature and for a period of time in an atmosphere having a carbon potential sufficient to form at least one preselected surface area on said article comprising carbides and austenite;

quenching said carburized article to a temperature below the $Ar_1$ temperature and above the $M_s$ temperature of the steel material for a time sufficient to transform at least about 70% of said austenite in the preselected surface area microstructure to lower bainite.

7. A method of forming a steel article having high toughness and hardness, as set forth in claim 6, wherein said quenching said carburized article to a temperature below the $Ar_1$ temperature and above the $M_s$ temperature of the steel material includes forming at least about 20% carbides on the preselected surface having a matrix microstructure consisting of at least about 70% lower bainite.

* * * * *